United States Patent [19]

Fujii et al.

[11] 4,246,165

[45] Jan. 20, 1981

[54] PREPARATION OF COATED CASTING SAND USING UNSATURATED POLYESTER RESIN AS BINDER

[75] Inventors: Shin Fujii, Zama; Koue Ookawa, Yokohama; Takashi Seino, Yokosuka, all of Japan

[73] Assignee: Nissan Motor Company, Limited, Yokohama, Japan

[21] Appl. No.: 967,541

[22] Filed: Dec. 7, 1978

[30] Foreign Application Priority Data

Dec. 9, 1977 [JP] Japan ..... 52-147213

[51] Int. Cl.[3] ..... C08L 67/06

[52] U.S. Cl. ..... 260/40 R

[58] Field of Search ..... 260/40 R, DIG. 40

[56] References Cited

U.S. PATENT DOCUMENTS

| | | | |
|---|---|---|---|
| 1,831,555 | 11/1931 | Earl | 260/DIG. 40 |
| 2,830,342 | 4/1958 | Meyers et al. | 260/DIG. 40 |
| 3,962,162 | 6/1976 | Schmonk | 260/DIG. 40 |

FOREIGN PATENT DOCUMENTS

| | | |
|---|---|---|
| 49-29318 | 9/1974 | Japan . |
| 50-104721 | 8/1975 | Japan . |
| 644287 | 10/1950 | United Kingdom . |
| 1007168 | 10/1965 | United Kingdom . |
| 1106191 | 3/1968 | United Kingdom . |
| 1272973 | 5/1972 | United Kingdom . |
| 1442836 | 7/1976 | United Kingdom . |

*Primary Examiner*—Lewis T. Jacobs

*Attorney, Agent, or Firm*—Schwartz, Jeffery, Schwaab, Mack, Blumenthal & Koch

[57] ABSTRACT

A crystalline unsaturated polyester, which is a scarcely tacky solid at room temperature but at a temperature somewhat above its softening temperature assumes a fluid state with a viscosity below about 500 poises, is used as a principal component of a binder for the preparation of a resin coated casting sand for use in shell mold casting of, particularly, aluminum alloys with an aim of facilitating the disintegration of molds and cores. The binder is mixed with a conventional foundry sand at an appropriately elevated temperature in the presence of an organic peroxide as a polymerization catalyst. The binder may preferably contain a cross-linking agent such as diallyl phthalate and optionally a silane as a coupling agent and/or a cross-linking accelerator.

33 Claims, 2 Drawing Figures

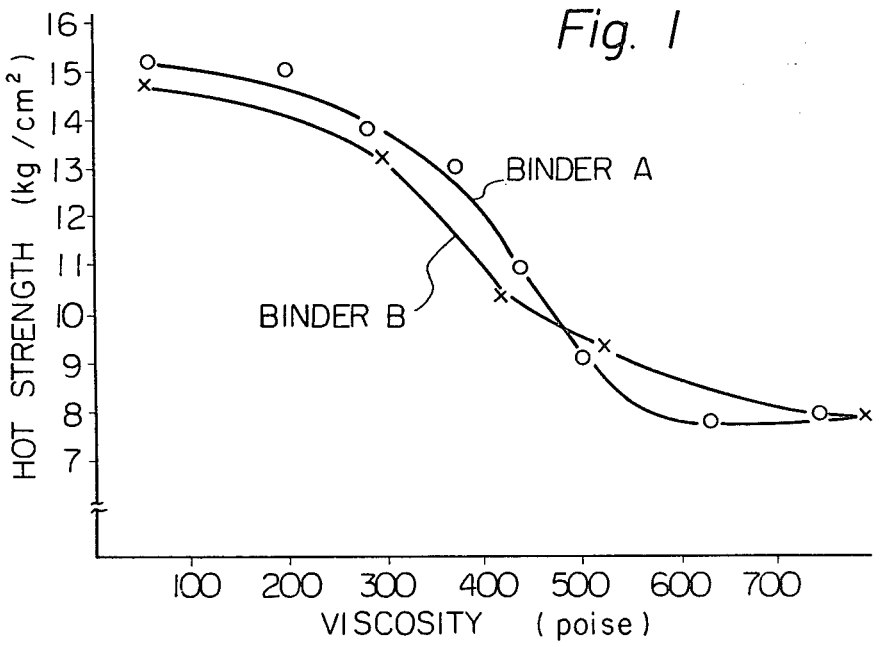
Fig. 2
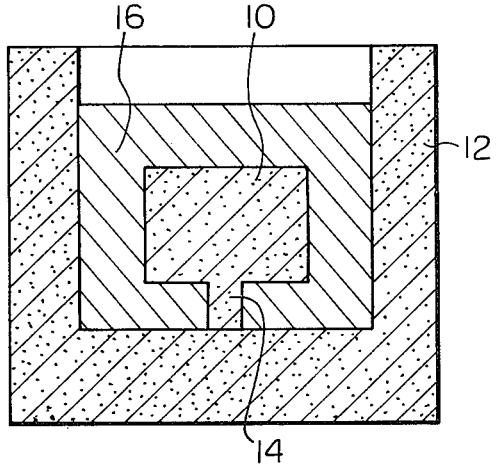

PREPARATION OF COATED CASTING SAND USING UNSATURATED POLYESTER RESIN AS BINDER

BACKGROUND OF THE INVENTION

This invention relates to a resin coated sand for the fabrication of molds and cores for use in sand mold casting and a process of preparing the same, and more particularly to a novel type of binder for the preparation of the coated sand.

In sand mold casting of aluminum alloys, molds and cores are usually made of resin coated sand, i.e. casting sand coated with a phenol resin. This type of coated sand has been used also in casting of cast irons. In the case of cast irons, molds and cores of resin coats sand can easily be disintegrated after solidication of the poured molten iron since a relatively high pouring temperature such as 1300°-1400° C. causes the resin to decompose and lose its bonding ability. However, the situation is different in casting of aluminum alloys. Due to the adoption of a relatively low pouring temperature such as 650°-750° C., molds and cores of resin coated sand retain their toughness even at the stage of shake-out and accordingly resist shocks and vibrations for shake-out. This is particularly significant for cores. In a relatively thick portion of a core, curing of the phenol resin proceeds during solidification of the poured molten metal because the interior of the core in such a portion does not undergo an efficient cooling. Even in a relatively thin portion of the core, the phenol resin undergoes partial carbonization mainly in its benzene rings because the core surrounded by the molten metal undergoes heating in an anoxic state. As a result, the sand particles adhere strongly to each other or to the aluminum alloy casting.

Because of difficulty in disintegrating molds and cores of resin coated sand, when casting of an aluminum alloy is performed by the use of complicated shaped cores it is usual to facilitate disintegration of the molds and cores by a shake-out machine by preliminarily baking mold assemblies containing castings for a period of time as long as 4-10 hours at 400°-500° C. This is of course unfavorable to the efficiency and cost of the casting process.

It may be concluded that the use of phenol resin as a binder for casting sand is not so desirable in general and, in the case of casting of aluminum alloys, is certainly undesirable.

A resin-base binder for the preparation of a coated casting sand should have such physical and chemical properties that molds and cores made of the coated sand are strong enough to serve for the purpose but, nevertheless, can easily be disintegrated after solidification of the poured molten metal. Furthermore, such a binder is desired to be solid and practically free of tackiness at room temperature so that the individual particles of the coated sand may not adhere to each other unless pressure or heat is applied thereto, but at a temperature slightly above its softening temperature becomes sufficiently low in its viscosity so that sand particles may be well wetted with the fluidized binder. For casting sand, however, none of the currently available or hitherto proposed binders simultaneously satisfies alloy these desires.

SUMMARY OF THE INVENTION

It is an object of the present invention to obviate the aforementioned drawback of conventional phenol resin coated casting sand.

It is another object of the invention to provide a process for the preparation of a novel type of resin coated sand to make molds and cores for sand mold casting of, for example, an aluminum alloy, which coated sand features easiness of disintegration of the molds and cores at the stage of shake-out as well as excellence in the high temperature strength of the molds and cores.

It is still another object of the invention to provide a foundry composition which is a mixture of a conventional foundry sand and a novel type of binder and through heating gives a coated sand having the above stated features.

A process according to the invention for the preparation of a resin coated casting sand comprises the step of mixing a major amount of a foundry sand with a minor amount of a binder, which comprises a crystalline unsaturated polyester as its principal component, at an elevated temperature at which the binder is in a fluid state in the presence of an organic peroxide which serves as a polymerization catalyst for the unsaturated polyester. The unsaturated polyester is one having an average molecular weight of about 1000 to about 2000. The binder is a scarcely tacky solid at room temperature, and the viscosity of the binder at a temperature about 30° C. above the softening temperature thereof is below about 500 poises.

In the present application, "crystalline unsaturated polyester" refers to a polyester which is at least partially crystalline to such an extent that crystalline domains can be clearly identified by X-ray diffraction, and the statement that either an unsaturated polyester or a binder comprising an unsaturated polyester is "scarcely tacky" means that the polyester or the binder can be divided into fragments which are individually smaller than 4 mm in the maximum dimension and entirely pass through a 4-mesh screen on a standard sieving machine.

As will be understood from the above statement, the essential feature of the invention resides in the use of a crystalline unsaturated polyester as a principal component of a binder for the preparation of a resin coated casting sand, and a foundry composition according to the invention is a mixture of a major amount of a foundry sand and a minor amount of the above stated binder. Usually it suffices that the weight ratio of the binder to the sand is in the range from 1:100 to 7:100.

Preferably, the binder comprises a cross-linking agent, which may be an unsaturated monomer and/or an unsaturated prepolymer, in such an amount that the weight ratio of this agent to the unsaturated polyester is not greater than 0.5:1.

Optionally, the binder may comprise a silane compound as a coupling agent and/or a cross-linking accelerator such as a metal soap or a tertiary amine.

The sand may be selected freely from conventional foundry sands, but a coated sand of an exceedingly high strength can be obtained by the use of a high purity silica sand containing at least 98 Wt% $SiO_2$.

BRIEF DESCRIPTION OF THE DRAWING

FIG. 1 is a graph showing experimental results illustrative of the relationship between the viscosity of a binder comprising an unsaturated polyester at an appropriately elevated temperature and the high temperature strength of a coated sand obtained by the use of the binder; and FIG. 2 is a sectional view of a mold assembly fabricated in Examples of the invention in a state filled with molten metal.

DESCRIPTION OF PREFERRED EMBODIMENTS

A crystalline unsaturated polyester useful in the present invention is obtained by reaction of an α- or β-unsaturated dibasic acid which is solid and crystalline at room temperature and a glycol. Examples of such an unsaturated dibasic acid are fumaric acid, mesaconic acid, fumaric anhydride, citraconic acid and itaconic acid, and substitution products of these acids. Two or more of these compounds may be used jointly. To obtain an unsaturated polyester with a high degree of crystallization, it is preferable to use a dibasic acid sterically having symmetry such as fumaric acid or mesaconic acid.

A portion of the α- or β-unsaturated dibasic acid may be replaced by a saturated dibasic acid such as terephthalic acid, dimethyl terephthalate, adipic acid, sebacic acid, azelaic acid, isophthalic acid, 3, 6-endomethylene-$\Delta^4$-tetrahydrophthalic anhydride, tetrahydrophthalic acid anhydride, hexahydrophthalic acid anhydride or anthracene-maleic anhydride, or an addition or substitution procuct of such an acid. To augment the degree of crystallization of the unsaturated polyester, it is preferable to select a saturated dibasic acid sterically having symmetry as exemplified by terephthalic acid, dimethyl terephthalate and adipic acid. It is possible to jointly use two or more of these saturated dibasic acids.

Examples of useful glycols are ethylene glycol, 1,4-butanediol, diethylene glycol, triethylene glycol, 1,6-hexanediol, neopentyl glycol, hydrogenated bisphenol A and metaxylene glycol, and substitution products of these compounds. Each of these glycols is solid and crystalline, or sterically has symmetry. Two or more of these glycols may be used jointly.

A polymerization reaction between an unsaturated dibasic acid and a glycol to give an unsaturated polyester will need no description in this specification. By using the above listed materials and controlling the degree of crystallization by a controlled cooling of the polymer once heated to a temperature above its softening point, it is possible to obtain an unsaturated polyester having an average molecular weight of 1000–2000 and being a scarcely tacky solid at room temperature. As another requirement in the present invention, an unsaturated polyester thus prepared should fluidize when heated beyond its softening temperature to have a viscosity below about 500 poises at a temperature about 30° C. above the softening temperature even when the polymer is heated in the form of a binder composition comprising an unsaturated monomer or prepolymer adopted as the aforementioned cross-linking agent. It is preferable that the polyester (the binder composition, too) has a viscosity below about 250 poises at a temperature in the range from about 100° C. to about 130° C. It is not difficult to obtain a crystalline unsaturated polyester which meets this requirement, too, by a conventional process.

Examples of organic peroxides useful as a catalyst for polymerization or copolymerization of the unsaturated polyester are benzoyl peroxide, lauroyl peroxide, ditert-butyl peroxyadipate, dicumyl peroxide, tert-butyl-peroxy-benzoate, methyl ethyl ketone peroxide and cumene hydroperoxide. If desired, two or more of such peroxides may be used jointly.

The polymerization catalyst is used in a quantity amounting to 0.1–10 parts, preferably 0.5–5 parts, by weight for 100 parts by weight of the unsaturated polyester. If the quantity of the catalyst is less than 0.1 Wt% of the unsaturated polyester, heating of a sand-binder mixture to cause polymerization of the polyester, or copolymerization with the cross-linking agent, requires an exceedingly long period of time. On the other hand, the effect of the catalyst does not significantly heighten even if the quantity of the catalyst exceeds 10 Wt% of the polyester. The catalyst may be admixed into the unsaturated polyester at the stage of preparing a binder according to the invention, but may alternatively be added at the stage of mixing the binder and a foundry sand.

Preferably, a binder according to the invention comprises a cross-linking agent for the unsaturated polyester. The cross-linking agent is an unsaturated monomer and/or an unsaturated prepolymer each capable of copolymerizing with the unsaturated polyester, and the weight ratio of the cross-linking agent to the unsaturated polyester is made to be not greater than 0.5:1.

Preferably, the cross-linking agent is selected from unsaturated monomers or prepolymers readily copolymerizable with the unsaturated polyester, good at high temperature resistance and low in volatility. Preferred examples are chlorostyrene, diallyl phthalate, triallyl cyanurate and diallyl benzenesulfonate. It is most preferable to use an unsaturated compound having ester bonds in its principal chain as exemplified by ortho-isodiallylphthalate.

Optionally, a binder according to the invention may comprise a silane compound as a coupling agent which is effective for enhancement of the strength of the coated sand when baked to form a mold or core. The weight ratio of the coupling agent to the total of the unsaturated polyester and the cross-linking agent in the binder is made to be not greater than 1:10. Examples of silane compounds useful as the coupling agent are γ-methacryloxypropyl-trimethyloxy-silane and γ-glycidroxypropyl-trimethyloxy-silane.

Besides, the binder may comprise an accelerator selected from metal soaps such as cobalt napthtanate and cobalt octoate and tertiary amines such as dimethylaniline and diethylenetriamine to shorten the curing time. It is desirable to use an accelerator which hardly promotes curing at room temperature but causes a rapid curing reaction at an appropriate baking temperature.

A binder according to the invention is required to be a liquid whose viscosity is below about 500 poises at a temperature higher than the softening temperature thereof by about 30° C. (The binder may contain the catalyst. In such a case, the viscosity requirement should be met by a fundamental composition excluding the catalyst). It is preferable that the viscosity of the binder becomes below about 250 poises at a temperature in the range from about 100° C. to about 130° C. As will be demonstrated hereinafter by an experiment, the high temperature strength of a coated sand prepared by the use of an unsaturated polyester as a principal component of a binder (and baked under a condition employed in the fabrication of molds and cores) hightens significantly as the viscosity of the binder lowers across 500 poises and reaches a fully satisfactory level when the viscosity is 250 poises or below. A probable reason for such dependence of the strength of the coated sand on the viscosity of the fluidized binder is that the sand particles cannot uniformly be wetted with the binder when the viscosity of the binder is above about 500 poises but can be wetted well with a binder whose viscosity is below about 500 poises. When the viscosity of the binder is below about 250 poises, it is presumed that the individual sand particles are almost ideally coated with the binder.

An ordinary silica sand commonly used as casting sand is of about 96% purity (by weight) as $SiO_2$. Of course such a grade of silica sand is of use also in the present invention. However, great improvements can be produced on the high temperature and ordinary temperature strength of a coated sand prepared by a process of the invention by utilizing a high purity silica sand containing at least 98% (by weight) $SiO_2$. Presumably, the reason for such improvements is a decrease in the contact angle between the sand particles and the binder with increase with the $SiO_2$ content in the sand, meaning that the high purity silica sand will be wetted with the binder more readily and thoroughly than the ordinary silica sand.

By way of example, the preparation of a coated sand by a process according to the invention is accomplished by first preheating a foundry sand to a temperature of 120°–200° C., charging the preheated sand into a speed mixer together with a binder according to the invention (for example, in the sand to binder weight ratio of about 100:5), and operating the mixer until the temperature of the sand becomes below the softening point of the binder. A wax or lubricant such as calcium stearate may optionally be added to the sand, in a quantity up to 3% (by weight) of the sand, together with the binder for the purpose of augmenting the fluidity of the coated sand. Molds and cores can be made of the thus prepared coated sand by a conventional method for the fabrication of shell type molds and cores. For example, the coated sand is poured into a metal mold which has been preheated to a temperature of 120°–250° C. depending on the widths and thicknesses of the intended casting mold or core and then baked for 30–180 seconds.

EXPERIMENT

The following experiment was carried out to examine the influence of the viscosity of a fluidized binder comprising an unsaturated polyester on the high temperature strength of a casting sand coated with this binder and baked thereafter.

(1) Preparation of Binder A

Using fumaric acid and ethylene glycol in 1:1 mole ratio, eight batches of crystalline unsaturated polyesters having different acid values ranging from 60 to 20 were prepared by varying the reaction time of an esterification reaction at a constant reaction temperature of 200° C. The softening temperatures of these unsaturated polyesters were in the range from 70° to 100° C. The eight batches of binder compositions were prepared by adding 5 parts by weight of ortho-diallyl phthalate monomer to 100 parts by weight of each of the eight batches of unsaturated polyesters maintained at 120° C., followed by sufficient stirring to accomplish thorough mixing. The binders were each subjected to measurement of viscosity at 120° C. with a Brookfield rotation viscometer (L-type) whose rotor was 3.175 mm in diameter. The revolution speed of the rotor was selected among 6, 12, 30 and 60 r.p.m. depending on the degree of fluidity of each binder. The viscosity values given by the measurement for the eight batches of binders were 740, 630, 500, 440, 370, 280, 200 and 60 poises.

(2) Preparation of Binder B

Using a mixture of fumaric acid and dimethyl-terephtalate (3:1 mole ratio) and 1,6-hexanediol in an equivalent proportion to the acid mixture, five batches of crystalline unsaturated polyesters having different acid values ranging from 60 to 20 were prepared by varying the reaction time of a conventional esterification reaction at a constant temperature of 200° C. The softening temperatures of these unsaturated polyesters were in the range from 60° to 105° C. Then five batches of binder compositions were prepared by adding 5 parts by weight of ortho-diallyl phthalate monomer to 100 parts by weight of each of the five batches of unsaturated polyesters maintained at 120° C., followed by stirring for a sufficient period of time. For these binder compositions, the viscosity values at 120° C. measured by the above described method were 50, 300, 430, 520 and 780 poises.

(3) Preparation of Coated Sand samples

To each of the eight batches of binders A and five batches of binders B (each 100 parts by weight), 2.1 parts by weight of dicumyl peroxide and 0.9 parts by weight of tert-butyl-peroxy-benzoate were added as catalyst. Each of the catalyst-containing binders was mixed with an ordinary silica sand and the mixture was kneaded by operating a speed mixer for 5 minutes to a resin coated sand. The thirteen batches of resin coated sand samples thus prepared were respectively formed into test pieces for tensile test by baking at 190° C. for 90 seconds, and immediatedly subjected to a tensile test with a high temperature strength tester for shell-type casting sand. The result of this test is presented in Table 1 and FIG. 1.

TABLE 1

| Binder A | | Binder B | |
|---|---|---|---|
| Viscosity (poises) | High Temperature Strength of Coated Sand (kg/cm$^2$) | Viscosity (poises) | High Temperature Strength of Coated Sand (kg/cm$^2$) |
| 60 | 15.3 | 50 | 14.8 |
| 200 | 15.0 | | |
| 280 | 13.8 | 300 | 13.3 |
| 370 | 13.0 | | |
| 440 | 10.9 | 430 | 10.4 |
| 500 | 9.1 | 520 | 9.3 |
| 630 | 7.8 | | |
| 740 | 8.0 | 780 | 7.8 |

The result of this test demonstrates that a resin coated casting sand prepared by using a polyester binder whose viscosity at 120° C. is below about 500 poises exhibits a remarkably higher strength compared with a resin coated casting sand prepared by using an analogous binder of a higher viscosity. Probably the binder in the former casting sand almost entirely takes the form of thin layers coated on the individual sand particles, whereas a considerable portion of the binder in the latter casting sand is merely dispersed in the sand without forming coating layers on the individual sand particles.

The invention will be illustrated by the following examples.

EXAMPLE 1

Use was made of a commercially available resin composition, N-20 of Mitsui Toatsu Chemical Co., Ltd., comprising as its principal ingredient a crystalline unsaturated polyester. It was confirmed by X-ray diffraction that the degree of crystallization of this resin composition was 27%. At 120° C., the viscosity of this resin composition was 270 poises. After the addition of 2.1 parts by weight of dicumly peroxide and 0.9 parts by weight of tert-butyl-peroxy-benzoate to 100 parts by weight of this resin composition, a resin coated casting sand was prepared by mixing an ordinary silica sand preheated to 180° C. with the resin composition and kneading the mixture for 5 min by means of a speed mixer. The sand particles were uniformly coated with the resin.

This resin coated sand was formed into test pieces for tensile test through 70 sec baking at 190° C. For comparison, a conventional phenol resin coated sand prepared by using the same silica sand was also formed into test pieces through 70 sec baking at 250° C. Table 2 shows the results of tensile test on these two kinds of coated sands. "Cold Strength" refers to tensile strength measured on test pieces cooled to room temperature after separation from a metal mold, and "Hot Strength" refers to tensile strength measured at the aforementioned baking temperatures immediately after completion of baking. Each numerical value in Table 2 is the average of measurements on ten test pieces.

TABLE 2

| | Cold Strength ($kg/cm^2$) | Hot Strength ($kg/cm^2$) |
|---|---|---|
| Conventional Phenol Resin Coated Sand (Resin/Sand = 3/100 by weight) | 24.3 | 15.0 (250° C.) |
| Resin Coated Sand of Invention (Resin/Sand = 5/100 by weight) | 25.5 | 15.1 (190° C.) |

As can be seen in Table 2, the coated sand according to the invention was a little higher in cold strength than the conventional phenol resin coated sand, but there was substantially no difference in hot strength between these two types of coated sands.

Next, ease of disintegration of a casting core made of the coated sand according to the invention (prepared in this example) was examined by the following test.

A cylindrical core having a diameter of 50 mm and a length of 30 mm was made of the coated sand according to the invention by baking the coated sand in a metal mold preheated to 180° C. As shown in FIG. 2, this core 10 was set longitudinally in a sand mold 12 which was made by the carbon dioxide process and had a cylindrical cavity 100 mm in diameter. The core 10 was formed with a cylindrical projection 14, which was 10 mm in diameter and 10 mm in height, so as to provide a sand discharge port to the casting. A molten aluminum-copper alloy (AC2A) 16 was poured into the mold 12 at a pouring temperature of 690° C. such that the top face of the cylindrical core 10 became 10 mm beneath the surface of the molten metal 16. After solidication of the poured molten metal 16 and cooling of the entire assembly, the mold 12 was broken to take out the casting (16) containing the core 10. The casting 16 was set on a ro-tap type sieving machine so as to be subjected to vibration and tapping thereby to cause disintegration of the core 10 in the casting 16. Immediately sand particles began to come out of the casting through the discharge port (14), and the disintegration of the core 10 and discharge of the sand were completed by operating the sieving machine only for 5 min. This operation was performed without being preceded by baking of the casting to weaken the bonding strength of the coated sand constituting the core 10. Thereafter the casting was cut to observe its internal structure, and it was confirmed that the casting was free of blows or other defects.

For comparison, the same test was conducted on a core 10) made of the conventional phenol resin coated sand. In this case, no quantity of sand was discharged from the casting while the sieving machine was operated continuously for 120 min. Even when the disintegration test was preceded by baking of the casing for 2 hr at 500° C., only a very small amount of the sand was discharged from the casting by continuing the operation of the sieving machine for 30 min.

Probably, a primary reason for remarkable ease of disintegration of a mold or core made of a coated sand according to the invention is that, at high temperatures resulting from pouring of a molten metal, oxygen atoms in the ester bonds of the unsaturated polyester promote decomposition of the unsaturated polyester.

In the case of the core 10 of the phenol resin coated sand, the core 10 gave out an unpleasant smell of ammonia upon pouring of the molten metal 16 into the mold 12. On the other hand, the core 10 of the coated sand according to the invention gave out no unpleasant smell.

EXAMPLE 2

A binder composition was prepared by the addition of 5 parts by weight of orth-diallyl phthatalate to 100 parts by weight of a crystalline unsaturated polyester which was one of the unsaturated polyesters B prepared in the above described Experiment and had an acid value of 45. This binder composition was solid at room temperature and assumed a crystalline state when once heated to 100° C. and then cooled slowly. The degree of crystallization was 24%, and the viscosity at 120° C. was 190 poises. Using this binder composition a resin coated sand was prepared in accordance with Example 1 (including the addition of the catalyst). The tensile strength of the coated sand was 25.0 $kg/cm^2$ at room temperature and 14.8 $kg/cm^2$ at 190° C. When the core 10 in FIG. 2 was made of the coated sand of this example, the core 10 in the casting 16 could be disintegrated substantially with the same ease as the core 10 made of the coated sand of Example 1.

COMPARATIVE EXPERIMENT 1

An unsaturated polyester was prepared by reaction of a mixture of maleic acid and phthalic anhydride (1:1 mole ratio) with metaxylene glycol until the acid value of the polymer became 20. This polyester was solid at room temperature but did not become crystalline even when slowly cooled from 120° C. The viscosity of this unsaturated polyester at 120° C. was about 1000 poises.

A resin coated sand was prepared by using this polyester and, in other respects, by the procedures of Example 1. The tensile strength of this resin coated sand was 12.1 $kg/cm^2$ at room temperature and 7.3 $kg/cm^2$ at 190° C., so that this resin coated sand was unsuitable for the fabrication of casting molds and cores. To obtain the unsaturated polyester prepared in this experiment as a solid at room temperature, it was necessary to make the molecular weight of the polyester as large as about 9000. Due to such a large molecular weight, the unsaturated polyester exhibited a very high viscosity at 120° C. and was poor in the strength of bonding with sand particles. It is considered, therefore, that the sand particles in this experiment could not be uniformly coated with the binder composition.

EXAMPLE 3

Cobalt naphthanate (0.3 parts by weight) was added to the binder composition prepared in Example 1 (100 parts by weight). Using the resultant binder composition, a resin coated sand was prepared by the method of Example 1 (the binder to sand weight ratio was 5:100). The tensile strength of this resin coated sand was 27.6 $kg/cm^2$ at room temperature and 15.4 $kg/cm^2$ at 160° C. (In this example, test pieces for the tensile test were formed by baking at 160° C. for 70 sec. The strength values were each an average of ten measurements.)

This example demonstrates that a resin coated sand having an exceedingly high tensile strength can be obtained by a process according to the invention and that such a resin coated sand can be formed into molds and cores by baking of the coated sand in a metal mold at a relatively low temperature.

The disintegration test (using the core 10 of FIG. 2) of Example 1 was made also for the resin coated sand prepared in this example. The result was almost identical with the test result in Example 1. Disintegration of the core 10 in the casting 16 and discharge of the sand from the casting were completed by operating the sieving machine only for 5 min.

EXAMPLE 4

A resin coated sand was prepared by applying the binder composition of Example 1 to Western sand (occurring in Australia, 99.6% purity as $SiO_2$, similar in particle size distribution to an ordinary silica sand for foundry use) by the procedure of Example 1. The tensil strength of this resin coated sand (resin/sand = 5/100 by weight) was 28.8 $kg/cm^2$ at room temperature and 16.6 $kg/cm^2$ at 190° C. In the disintegration test, the core 10 was disintegrated and the sand was entirely discharged from the casting 16 by operating the sieving machine for 5 min.

This example demonstrates that the use of a high purity silica sand in the present invention produces a remarkable improvement on the tensile strength of a resultant resin coated sand both at room temperature and at high temperatures.

EXAMPLE 5

As a coupling agent, γ-methacryloxy-propyltrimethoxysilane was added to the binder composition of Example 1 in a proportion of 3 parts by weight of the coupling agent to 100 parts by weight of the unsaturated polyester in the binder composition. Using the resultant binder composition, a resin coated sand (resin/sand = 5/100 by weight) was prepared in accordance with Example 1.

The tensile strength of this resin coated sand was 28.2 $kg/cm^2$ at room temperature and 18.2 $kg/cm^2$ at 190° C. The result of the disintegration test for this resin coated sand was substantially identical with the test result in Example 1. This example demonstrates a favorable influence of a silane coupling agent on the strength of a resultant resin coated sand.

EXAMPLE 6

An unsaturated polyester was prepared by a known esterification reaction between a mixture of fumaric acid and terephthalic acid (3:1 mole ratio) and 1,6-hexanediol in a quantity equivalent to the acid mixture. This unsaturated polyester was solid at room temperature and became crystalline when slowly cooled from 100° C. The degree of crystallization was 24%, and the viscosity at 100° C. was about 120 poises. Using a binder mixture obtained by the addition of the cross-linking agent and the catalyst used in Example to this unsaturated polyester, a resin coated sand was prepared by the method of Example 1.

The tensile strength of this resin coated sand was 25.0 $kg/cm^2$ at room temperature and 14.8 $kg/cm^2$ at 190° C. The result of the disintegration test for this resin coated sand was substantially identical with the test result in Example 1.

COMPARATIVE EXPERIMENT 2

An unsaturated polyester was prepared by reaction between maleic acid and an equivalent quantity of ethylene glycol. This unsaturated polyester was solid at room temperature but did not become crystalline even when slowly cooled from 100° C. The viscosity of this polyester at 100° C. was about 1000 poises.

Example 1 was repeated except that the unsaturated polyester prepared in this experiment was used in place of the crystalline unsaturated polyester used in Example 1. The tensile strength of the obtained resin coated sand was 12.1 $kg/cm^2$ at room temperature and 7.3 $kg/cm^2$ at 190° C., so that this resin coated sand was unsuitable for use in the fabrication of cores.

Similarly to the unsaturated polyester prepared in Comparative Experiment 1, it was necessary to make the molecular weight of the unsaturated polyester of this experiment as large as 8000–10,000 in order to obtain the polyester as solid at room temperature. Therefore, it is considered that the sand particles could not be uniformly coated with the binder composition of this experiment.

What is claimed is:

1. A process of preparing a resin coated sand for the fabrication of molds and cores for use in sand mold casting, the process comprising the step of:

mixing a major amount of a foundry sand with a minor amount of a binder composition, which comprises a crystalline unsaturated polyester as a principal component thereof, at an elevated temperature at which said binder composition is in a fluid state in the presence of an organic peroxide which serves as a polymerization catalyst for said crystalline unsaturated polyester, said crystalline unsaturated polyester having an average molecular weight of about 1000 to about 2000, said binder composition being a scarcely tacky solid at room temperature and, the viscosity of said binder composition at a temperature about 30° C. above the softening temperature thereof being below about 500 poises.

2. A process according to claim 1, wherein said binder composition has a viscosity below about 250 poises at a temperature in the range from about 100° C. to about 130° C.

3. A process according to claim 1, wherein said binder composition further comprises a cross-linking agent which can copolymerize with said crystalline unsaturated polyester in the presence of said catalyst, the weight ratio of said cross-linking agent to said unsaturated polyester being not greater than 0.5:1.

4. A process according to claim 1, wherein said cross-linking agent is selected from the group consisting of chlorostyrene, diallyl phthalate, triallyl cyanurate and diallyl benzenesulfonate.

5. A process according to claim 1, wherein said binder composition further comprises a coupling agent selected from the group consisting of γ-methacryloxy-propyl-trimethyloxysilane and γ-glycidroxy-propyl-trimethyloxysilane, the weight ratio of said coupling agent to the total of said crystalline unsaturated polyester and said cross-linking agent being not greater than 1:10.

6. A process according to claim 1, wherein said binder composition further comprises a metal soap serving as a curing accelerator selected from the group consisting of cobalt naphthanate and cobalt octoate.

7. A process according to claim 1, wherein said binder composition further comprises a tertiary amine serving as a curing accelerator selected from the group consisting of dimethylaniline and diethylenetriamine.

8. A process according to claim 1, wherein said foundry sand is a high purity silica sand containing at least 98% by weight of $SiO_2$.

9. A foundry composition for the fabrication of molds and cores for use in sand mold casting, comprising:

a major amount of foundry sand; and a minor amount of a binder composition which comprises a crystalline unsaturated polyester as a principal component thereof, said crystalline unsaturated polyester having an average molecular weight of about 1000 to about 2000, said binder composition being a scarcely tacky solid at room temperature, and the viscosity of said binder composition at a temperature about 30° C. above the softening temperature thereof being below about 500 poises.

10. A foundry composition according to claim 9, wherein said binder composition further comprises a cross-linking agent which can copolymerize with said crystalline unsaturated polyester, the weight ratio of said cross-linking agent to said unsaturated polyester being not greater than 0.5:1.

11. A process according to claim 1, wherein the weight ratio of said binder composition to said foundry sand being in the range of from about 1:100 to 7:100.

12. A process according to claim 11, wherein the acid component of said crystalline unsaturated polyester comprises an α-or β-unsaturated dicarboxylic acid which is solid and crystalline at room temperature.

13. A process according to claim 12, wherein said acid component is sterically symmetrical.

14. A process according to claim 12, wherein said acid component comprises fumaric acid, mesaconic acid, fumaric anhydride, citraconic acid, itaconic acid or a substitution product thereof.

15. A process according to claim 14, wherein said acid component comprises fumaric acid.

16. A process according to claim 11, wherein the acid component of said crystalline unsaturated polyester comprises at least one unsaturated dibasic acid comprising fumaric acid, mesaconic acid or a substitution product thereof, and the glycol component of said crystalline unsaturated polyester comprises at least one glycol comprising ethylene glycol, 1,4-butanediol, diethylene glycol, triethylene glycol, 1,6-hexanediol, neopentyl glycol, hydrogenated bisphenol A, metaxylene glycol or a substitution product thereof.

17. A process according to claims 12, 14 or 16, wherein the acid component of said crystalline unsaturated polyester further comprises at least one saturated dicarboxylic component comprising terephthalic acid, dimethyl terephthalate, adipic acid, sebacic acid, azelaic acid, isophthalic acid, 3,6-endomethylene-$\Delta^4$-tetrahydrophthalic anhydride, tetrahydrophthalic acid anhydride, hexahydrophthalic acid anhydride, anthracene-maleic anhydride or an addition or substitution product thereof.

18. A process according to claim 17, wherein said saturated dicarboxylic component comprises terephthalic acid, dimethyl terephthalate, adipic acid or an addition or substitution product thereof.

19. A foundry composition according to claim 9, wherein the weight ratio of said binder composition to said foundry sand being in the range of from about 1:100 to 1:700.

20. A foundry composition according to claim 19, wherein said binder composition has a viscosity below about 250 poises at a temperature in the range from about 100° C. to about 130° C.

21. A foundry composition according to claim 19, wherein said cross-linking agent is selected from the group consisting of chlorostyrene, diallylphthalate, triallylcyanurate and diallylbenzenesulfonate.

22. A foundry composition according to claim 19, wherein said binder composition further comprises a coupling agent selected from the group consisting of γ-glycidroxypropyl-trimethyloxsilane, the weight ratio of said coupling agent to the total of said crystalline unsaturated polyester and said cross-linking agent being not greater than 1:10.

23. A foundry composition according to claim 19, wherein said binder composition further comprises a metal soap serving as a curing accelerator selected from the group consisting of cobalt naphthanate and cobalt octoate.

24. A foundry composition according to claim 19, wherein said binder composition further comprises a tertiary amine serving as a curing accelerator selected from the group consisting of dimethylaniline and diethylenetriamine.

25. A foundry composition according to claim 19, wherein said foundry sand is a high purity silica sand containing at least 98% by weight of $SiO_2$.

26. A foundry composition according to claim 19, wherein the acid component of said crystalline unsaturated polyester comprises an α- or β- unsaturated dicarboxylic acid which is solid and crystalline at room temperature.

27. A foundry composition according to claim 26, wherein said acid component is sterically symmetrical.

28. A foundry composition according to claim 26, wherein said acid component comprises fumaric acid, mesaconic acid, fumaric anhydride, citnaconic acid, itaconic acid or a substitution product thereof.

29. A foundry composition according to claim 28, wherein said acid component comprises fumaric acid.

30. A foundry composition according to claim 19, wherein the acid component of said crystalline unsaturated polyester comprises at least one unsaturated dibasic acid comprising fumaric acid, mesaconic acid or a substitution product thereof, and the glycol component of said crystalline unsaturated polyester comprises at least one glycol comprising ethylene glycol, 1,4-butanediol, diethylene glycol, triethylene glycol, 1,6-hexanediol, neopentyl glycol, hydrogenated bisphenol A, metaxylene glycol or a substitution product thereof.

31. A foundry composition according to claim 26, 28 or 30, wherein the acid component of said crystalline unsaturated polyester further comprises at least one saturated dicarboxylic component comprising terephthalic acid, dimethyl terephthalate, adipic acid, sebacic acid, azelaic acid, isophthalic acid, 3/6-endomethylene-$\Delta^4$-tetrahydrophthalic anhydride, tetrahydrophthalic acid anhydride, hexahydrophthalic acid anhydride, anthracene-maleic anhydride or an addition or substitution product thereof.

32. A foundry composition according to claim 31, wherein said saturated dicarboxylic component comprises terephthalic acid, dimethyl terephthalate, adipic acid or an addition or substitution product thereof.

33. A process for sand mold casting of aluminum alloys, comprising the steps of (a) preparing a resin coated sand in accordance with the process defined by claim 1;

(b) preparing at least a core portion of a mold from said resin coated sand;

(c) casting an aluminum alloy in said mold at a temperature at which said alloy is molten;

(d) solidifying said alloy to produce a solid molded piece; and (e) shaking-out said mold core from said solid molded piece without subjecting said piece to a temperature above said casting temperature.

* * * * *